US006413631B1

(12) United States Patent
Alston et al.

(10) Patent No.: US 6,413,631 B1
(45) Date of Patent: Jul. 2, 2002

(54) PROCESS OF OPEN-END SPINNING OF POLYESTER STAPLE FIBER

(75) Inventors: Peter Van Alston, Kinston; Patrick Joseph Duncan, Wilmington, both of NC (US); Steven Michael Hansen, Charlottesville, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/101,566

(22) PCT Filed: May 4, 1998

(86) PCT No.: PCT/US98/09043

§ 371 (c)(1),
(2), (4) Date: Oct. 18, 2000

(87) PCT Pub. No.: WO98/50608

PCT Pub. Date: Nov. 12, 1998

Related U.S. Application Data

(63) Continuation-in-part of application No. 08/850,457, filed on May 5, 1997, now Pat. No. 6,010,789.

(51) Int. Cl.[7] ..... D01F 6/00; D01F 6/62

(52) U.S. Cl. ..... 428/364; 428/395; 428/397

(58) Field of Search ..... 428/364, 397, 428/395

(56) References Cited

U.S. PATENT DOCUMENTS

| | | | | |
|---|---|---|---|---|
| 2,744,087 A | | 5/1956 | Snyder | 260/75 |
| 3,223,581 A | | 12/1965 | Sommer et al. | |
| 3,816,486 A | | 6/1974 | Vail | 260/75 |
| 3,914,488 A | | 10/1975 | Gorrafa | 428/397 |
| 4,012,557 A | | 3/1977 | Cornelis | 428/397 |
| 4,410,579 A | | 10/1983 | Johns | 428/131 |
| 4,634,625 A | | 1/1987 | Franklin | 428/258 |
| 4,666,454 A | | 5/1987 | De Martino et al. | 8/494 |
| 4,702,875 A | | 10/1987 | Jennings | 264/177.13 |
| 4,704,329 A | | 11/1987 | Hancock et al. | 428/369 |
| 4,707,407 A | | 11/1987 | Clark et al. | 428/361 |
| 4,729,214 A | | 3/1988 | Yngve et al. | 57/6 |
| 4,801,503 A | | 1/1989 | Jennings | 428/399 |
| 4,845,946 A | * | 7/1989 | Deussen | |
| 5,219,506 A | | 6/1993 | Anderson et al. | 264/143 |
| 5,219,582 A | | 6/1993 | Anderson et al. | 425/72.2 |
| 5,223,187 A | | 6/1993 | Chantry et al. | 264/25 |
| 5,591,523 A | | 1/1997 | Aneja | 428/357 |
| 5,626,961 A | | 5/1997 | Aneja | 428/397 |

FOREIGN PATENT DOCUMENTS

| | | |
|---|---|---|
| DE | 28 24 500 | 12/1979 |
| DE | 30 11 118 A1 | 10/1981 |
| DE | 42 09 970 A1 | 9/1993 |
| GB | 2 221 186 A | 1/1990 |
| JP | 62-057913 A | 3/1987 |
| JP | 4-119118 | 4/1992 |
| JP | 4-370209 | 12/1992 |

OTHER PUBLICATIONS

PCT International Search Report for PCT/US 98/09043; dated Sep. 1998.

Abstract of JP–62170543–A (published Jul. 27, 1987).*

Abstract of JP–04034033–A (published Feb. 5, 1992).*

Abstract of JP–07252740–A (published Oct. 3, 1995).*

* cited by examiner

*Primary Examiner*—Leo B. Tentoni
(74) *Attorney, Agent, or Firm*—Charles E. Krukiel

(57) ABSTRACT

Polyester yarns whose polyester fibers are of simple oval peripheral cross-section of aspect ratio at least about 1.85:1 have shown better dye yield in fabrics than polyester staple fibers having lower aspect ratios. Such superior cross-sections for polyester staple fibers have also provided advantages in open-end spinning in providing yarns with fewer spinning failures than fibers of conventional round cross-section.

3 Claims, 3 Drawing Sheets

PROCESS OF OPEN-END SPINNING OF POLYESTER STAPLE FIBER

CROSS-REFERENCE TO RELATED APPLICATION

And application is a continuation-in-part of our prior application No. 08/850,457, filed May 5, 1997, now U.S. Pat. No. 6,010,789

This application is a 376 of PCT/US98/09043 filed May 4, 1998

FIELD OF INVENTION

This invention relates to improvement in polyester yarn, and is more particularly concerned with providing new yarns of polyester fibers that may be continuous or cut and that have an improved cross-section in that the periphery of the new cross-section is a simple oval contour that provides advantages in improved dye yield, and also in aesthetics, and in open-end spinning of such cut fibers, and that may be in the form of spun yarns prepared from spinning such new fibers, and in downstream products of such fibers and yarns, and in processes for obtaining such fibers, yarns and downstream products.

BACKGROUND OF THE INVENTION

Most synthetic yarns, including yarns of polyester fibers, can be classified into two groups, namely (1) continuous filament yarns and (2) so-called "spun yarns" of fibers that are discontinuous, which latter are often referred to as staple fibers or cut fibers.

In relation to the latter group, polyester staple fibers are first formed by extrusion into continuous polyester filaments, which are processed in the form of a tow of continuous polyester filaments, before the filamentary tow is converted into staple, which is then spun into spun textile yarn, often from blends of polyester fiber with other fibers, mostly cotton fibers or other natural and/or synthetic fibers.

Virtually all polyester staple fibers used to make commercial yarns for the apparel market (except for those in some selected specialty applications) have been of round cross-section for practical and economic reasons. The cross-sectional shape is established by the fiber producer primarily during melt-spinning and is then essentially fixed during drawing and annealing steps used to strengthen the fiber and to stabilize the fine structure of the polyester. Once established by the fiber producer, the cross-section of staple fiber generally remains essentially unchanged during subsequent mill processing steps used to form the yarns, fabrics and garments. Increasing the complexity of the cross-sectional shape (i.e., making and using any cross-section other than round) has generally increased processing difficulty and costs for fiber producers and especially for fiber processors.

Most commercially available continuous filament yarns have also been of round cross-section, although there have been various suggestions, especially in the patent literature, of spinning specific non-round filaments.

Both terms "fiber" and "filament" are used generically herein to include both continuous filaments and staple fiber (cut fiber) unless continuous filaments or staple fiber (cut fiber) are specifically mentioned.

Fiber producers prefer to manufacture round fibers over non-round fibers because melt-spinning (extruding) round filaments is most efficient and economical. Round orifices can be easily and economically fabricated. Further, melt-spinning processes used for round filaments are less demanding than for non-round filaments in that filament formation requires less strict control of polymer viscosity and air quenching to achieve acceptable quality. Immediately after extrusion, the melt tends to swell and form a bulge under the capillary orifice. Additionally, the uniform and symmetrical surface of the round shape minimizes directional influences during the filament-forming operation and maximizes the opportunity for increasing uniformity of fiber tensile, crimp and lubrication properties, uniformity generally being highly desirable.

Likewise, textile processors have preferred to process round fibers over non-round fibers in their normal processing operations. It is especially true that round fibers have been easier and more cost-efficient to transform into spun yarns and fabric; this has been the case particularly in the textile operations of carding, drafting and spinning used to transform the raw cut polyester staple fiber into spun textile yarn. No doubt this has resulted partly from the better property uniformity as discussed above and partly from the uniform friction and processing characteristics of the symmetrical round surface.

Round fibers have also been highly desirable for their economic dyeability and coloring characteristics. Of all potential cross-sections, round fibers possess minimum surface area to color and, therefore, require less dyestuff for coloration, in contrast to any non-round cross section which must necessarily have increased surface area, so would be expected to dye with lower yield and, therefore, generally require a higher level of costly dyestuffs to achieve the same coloration as a round cross-section.

Textile designers have always been searching for ways to vary aesthetics of fabrics. Different cross-sectional shapes of fibers could provide different aesthetics in fabrics and garments. The economic penalty required to dye non-round synthetic fibers, however, has been a serious disadvantage heretofore.

As indicated, both fiber producers and textile mill operators have been driven by economic considerations, so polyester fibers with non-round cross-sections have found little to no use in high volume commodity blends applications, especially in polyester/cotton for the commodity apparel market. The few examples of non-round fibers in the apparel market have been limited to specialty fibers that have provided marketable visual and/or performance fabric and garment attributes that have commanded point of sales premiums to off-set the necessary added producer and textile mill costs.

This invention, in contrast, provides a commodity polyester fiber of non-round cross-section that provides, surprisingly, yarns and fabrics that have shown dye yields equivalent or near equivalent to round fibers, as well as other advantages, including improved open-end spinning performance over round fibers, as will be explained hereinafter.

SUMMARY OF THE INVENTION

According to one aspect, the present invention provides improved yarn comprising polyester fiber of simple oval cross-section of aspect ratio about 1.85:1 to about 3.5:1. "Simple" oval cross-section is discussed and distinguished from a more complex oval cross-sectional shape hereinafter. Preferably, the aspect ratio is at least about 2.0:1, especially about 2.1–2.5:1.

We have found that yarns and fabrics of such polyester fibers can be dyed with little or no loss in coloration (i.e., dye yield) using the same weight percent of dyestuff as the commodity round fibers. In contrast, fibers with other oval cross-sections have dyed significantly lighter than round fibers when the same amount of dyestuff has been provided for such fibers, as will be discussed hereinafter.

We have also found that such fibers in the form of staple (cut fiber) have provided efficiency gains in open-end spinning as compared with conventional fibers of round cross-section, by reducing spinning interruptions at fixed processing speeds, or by allowing processing speeds to be increased without exceeding normal mill accepted interruption level with a consequent gain in mill productivity.

According to further aspects of the invention, therefore, there are provided a process of open-end spinning polyester staple fiber alone, or mixed with cotton, said polyester fiber having a simple oval cross-section of aspect ratio about 1.85:1, and preferably at least about 2.0:1, to about 3.5:1, and especially about 2.1–2.5:1, and open-end spun yarns of polyester staple fiber having a simple oval cross-section of aspect ratio from about 1.85:1, and preferably at least about 2.0:1, to about 3.5:1, and especially about 2.1:2.5:1, either alone or mixed with cotton.

Also provided according to the invention are fabrics and garments of such new yarns.

DETAILED DESCRIPTION OF PREFERRED EMBODIMENTS

Figure 1:
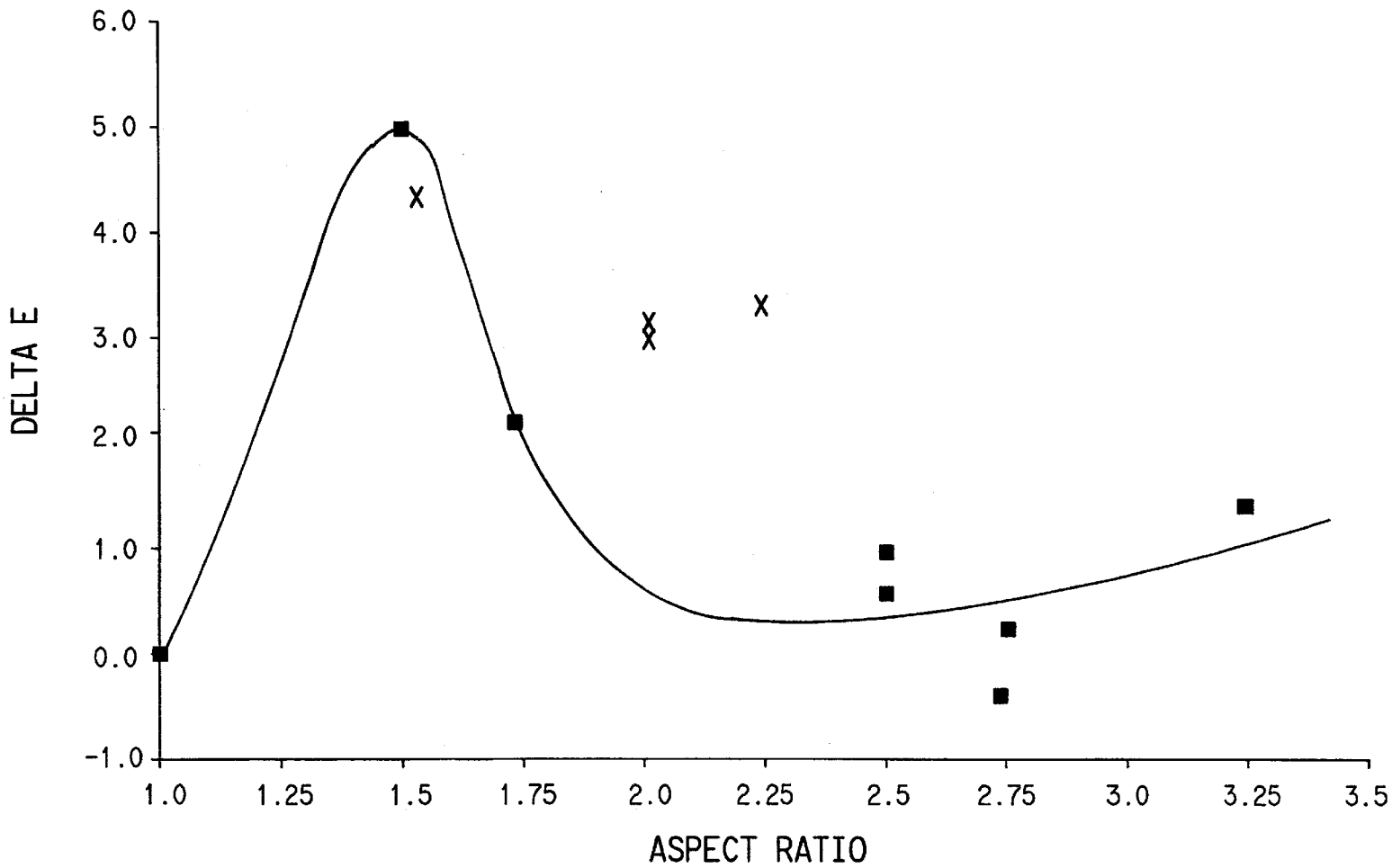
FIG. 1 compares the Dye Yield (ΔE) values of dyed fabrics tested of spun yarns of several polyester fibers having different cross-sections vs. the aspect ratios of the various cross-sections, as will be discussed in greater detail hereinafter.

Since the invention was developed in the course of improving productivity in open-end spinning, much of the detailed description concerns open-end spinning. Advantages of the invention are not, however, confined to open-end spinning, as will be evident hereinafter.

Much of the technology of preparing polyester fibers and processing, e.g., for spinning into spun yarns has been described in the art, so it would be redundant to repeat such disclosure in great detail herein. Spinning staple fibers (which are discontinuous) into continuous yarns or threads, which are generally referred to as "spun yarns" to distinguish them from continuous filament yarns, is one of the oldest processes known to human beings, for instance the use of a spinning wheel. Earlier in the present century, the process generally used commercially was "ring spinning". More recently, however, ring spinning is being mostly replaced by other methods, primarily "open-end spinning", sometimes referred to as "rotor spinning", and by air jet spinning. Finishes suitable for open-end spinning and other types of spinning are used commercially and known to those in the art. Aspects of the open-end spinning process, improvements in which are provided by the present invention, have been discussed and described in numerous publications over the last three decades. So far as we know, however, little has been published in the art about the effects on spinning processes of using fibers of different cross-section.

Open-end spinning is sometimes referred to as OES herein. OES provides a different softer yarn structure than that obtained by air jet spinning. The consequently softer aesthetics of OES yarns are preferred for many end-uses, air-jet yarns having harsher aesthetics because of their different formation and their resulting different yarn structure. The pilling performances of the yarn structures also differ.

Most commodity polyester polymer used for textile fibers has been ethylene terephthalate polymer of 14 to 24 relative viscosity (LRV). The polymer may be modified, e.g., with polyethylene oxide (PEO) of molecular weight about 200–2000, in amount about 1 to 5 % by weight, to enhance fiber dye rates. Polymer preparation may also include the use of a trifunctional or tetrafunctional chain brancher in amount up to about 0.5 mole %, especially up to about 0.35 mole %, to enhance melt-viscosity as necessary to achieve the desired cross-section shape definition. More recently, interest has been shown in fibers of trimethylene terephthalate polymer (sometimes referred to as 3G-T to differentiate from 2G-T for polyethylene terephthalate) and tetramethylene terephthalate (4G-T) fibers.

The polymer preferably includes a delusterant and/or optical brighteners to screen the normal discolorations associated with polymer manufacture, especially when polymer modifiers are employed, e.g., about 0.1 to about 0.4% by weight of titanium dioxide.

Polyethylene terephthalate containing polyethylene glycol has already been disclosed in the art, e.g., by Snyder in U.S. Pat. No. 2,744,087 and by De Martino in U.S. Pat. No. 4,666,454. Similarly, Vail U.S. Pat. No. 3,816,486, and Hancock et al., U.S. Pat. No. 4,704,329 have disclosed examples of processing techniques for preparing drawn annealed fibers and various polymers, and of polymer compositions that may be produced and used according to this invention. Use of copolyester compositions may require adjustment of viscosity appropriately, as described in the art.

Fibers have generally been of 0.9 to 1.5 dpf (1 to 1.7 dtex) and have generally been cut to staple lengths of 32–38 mm to be suitable for open-end and other types of spinning, but may be from 1 inch (25mm) to 2 inches (50mm) and are preferably at least 1.25 inches (30mm) and preferably up to 40mm cut length. Several people in the trade have shown interest recently in the potential for lower dpf fibers, as indicated, e.g., by Collins et al. in U.S. Pat. Nos. 5,250,245 and 5,288,553 and also Anderson et al in U.S. Pat. Nos. 5,219,506 and 5,219,582, who have disclosed lower dpf staple fibers of as low as 0.5 dtex (0.4 dpf), so there is a potential for such lower dpf fibers as feed fibers for OES and for other types of spinning, as well as for feed fibers that are of more conventional dpf. Mixed deniers, and/or mixed cross-sections including those of the invention with round fibers and other combinations may be used, if desired and advantageous.

Figure 4:
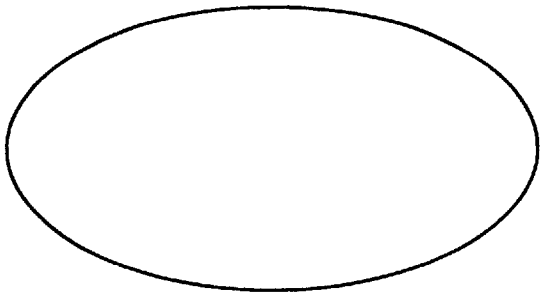
FIGS. 4 and 5 are artistic representations of simple oval cross-sections of aspect ratios 1.85:1 and 3.5:1, respectively.
Figure 5:
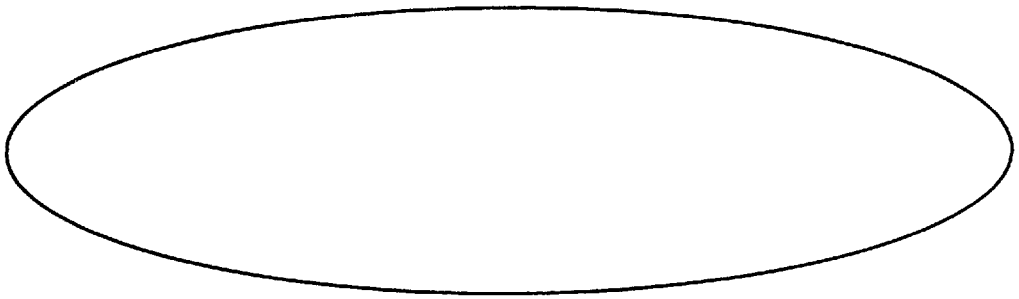

According to the invention, an essential feature is the cross-sectional peripheral shape of the polyester fibers which should be a simple oval of aspect ratio from about 1.85:1 (as shown in FIG. 4), preferably at least about 2.0:1, to about 3.5:1 (as shown in FIG. 5). We use the term "simple oval" herein to distinguish from more complex cross-sections such as, for example, those with deep grooves or indentations or scallops as are disclosed by Gorrafa in U.S. Pat. No. 3,914,488, Franklin in U.S. Pat. No. 4,634,625, Clark et al in U.S. Pat. No. 4,707,407, by Aneja in U.S. Pat. Nos. 5,591,523, 5,626,961, and 5,736,243 (corresponding to WO/97/02374) and by Roop in Application No. 08/778,462

(DP-6550) filed Jan. 3, 1997, now allowed and corresponding to PCT/US97/23708. The dye yield of fabrics of polyester staple fiber of scalloped-oval cross-section such as was disclosed, for example, by Gorrafa has been compared with that for polyester staple fiber of simple oval cross-section within the range according to the invention and the results are included in Example 1 hereinafter, the Gorrafa cross-section being referred to as "4gSO" in Table 1 (for 4 groove scalloped-oval) and its dye yield being 6 shades light, as compared to less than 1 and only 2 shades light for the staple fibers of the invention. Although such scalloped-oval cross-sections are not desirable according to the invention, and a smooth oval cross-section is preferred, as will be understood, minor variations from a smooth oval periphery may not significantly increase the dye required and are likely to provide improved OES capability over round fibers.

Also compared in several of the Examples hereinafter vs. polyester staple fiber of simple oval cross-section according to the invention were polyester staple fiber of "Peanut" cross-section, this term for a filament cross-section having been used, for example, in Japanese Patent Application Publication (Kokai), No.: Heisei 4-370,209 (Tanaka Kikinzoku KKK), published Dec. 22, 1992, and being self-explanatory and indicating a peripheral cross-section that has a significant neck halfway along the major axis, instead of having its maximum width at where the minor axis of a simple oval would be located, so a peanut cross-section is not a simple oval cross-section.

Japanese Patent Application Publication Kokai Hei 4-119118 described a polyester fiber with "oval and deformed cross-section" that was not a simple oval; it mostly described use as filament yarns, adding that its fiber could be "of filament or flocculent type"; it referred to several earlier Japanese published applications with various cross-sections that did not, apparently, disclose polyester fibers having a simple oval cross-section.

Surprisingly, there has been little discussion of polyester continuous filaments or staple fiber having a simple oval cross-section in the prior art. Johns U.S. Pat. No. 4,410,579 claimed apertured nonwoven fabric of hydraulically-entangled polyester fibers of ribbon-shaped cross-section whose aspect ratio was in the range of 1.8:1 to 3:1, an advantage of such fabrics being their improved disentanglement resistance (see, e.g., col 1, lines 48–52 and FIG. 1). Johns generally used the term "ribbon-shaped" without illustration or further elaboration, but stated that the term meant generally rectangular or oval in shape (col 2, lines 29–30). Johns did not teach any type of yarn spinning from staple fiber. Johns used only hydraulic entangling to form nonwoven fabrics directly from staple fiber. Johns did not disclose any yarns, either continuous filament yarns or spun yarns of staple fiber, but only apertured non-woven fabrics by hydraulic entanglement of staple fibers. Chantry et al, U.S. Pat. No. 5,223,187 claimed a continuous process of preparing a high strength monofilament of denier 1,000–10,000 from polyester of very high intrinsic viscosity, such heavy denier monofilaments preferably being of oblong cross-section, with width-thickness ratio greater than 2.0 (col 4, lines 6–12), for use in reinforcing tires. Similarly, Henning, GB 2 221 186 A, disclosed high strength nylon monofilaments of high denier from high viscosity polyamide, desirably of obround cross-section, i.e., a generally flat, ribbon-like cross-section with rounded corners (top of page 6). Other disclosures of nylon filaments are Cornelis U.S. Pat. No. 4,012,557, disclosing treating nylon-6 in powder form with aqueous KBr or NaBr and extruding it to form a filament of oval cross-section (e.g., col 4, lines 8, et seq), the dimensions of the resulting filament not being disclosed by Cornelis, and Jennings in U.S. Pat. No. 4,702,875 and 4,801,503, disclosing and illustrating (FIG. 2) high tenacity nylon filaments having a ribbon cross-section of length to width ratio greater than 3.

Aspect ratio is the ratio of the major axis to the minor axis of the peripheral cross-section of the polyester staple fiber. As may be seen from the comparative data in Example 1 (Table I), low aspect ratios of 1.5:1 and 1.7:1 for Comparisons D and E would not provide as much advantage as we have obtained by use of staple fiber having cross-sections with higher aspect ratios of about 1.85:1 or more, because Comparisons D and E dyed significantly lighter in shade and so would require significantly more dyestuff; this is also referred to later herein, in relation to FIG. 1. We prefer to use polyester fiber of simple oval cross-section having aspect ratios of up to about 3:1. As the aspect ratio increases, there is a tendency towards "glitter" , so an aspect ratio of more than about 3.5:1 is generally not desirable, and the desire to avoid "glitter" is one reason why ribbon-shaped cross-sections are not desirable, such ribbon-shaped cross-sections having been mentioned in the art referred to hereinabove.

This invention is further illustrated in the following Examples. All parts, proportions and percentages are by weight unless otherwise indicated.

In each Example, sample filaments of different oval cross-sections were melt-spun from the same polymer recipe and polymer viscosity through different capillaries to give the desired cross-sectional shapes for comparison in dye yield and open-end spinning. Also for comparison, to serve as a control, i.e., to show the state of the current commercial art, round filaments were dyed and spun in the same manner as the test items.

Figure 2:
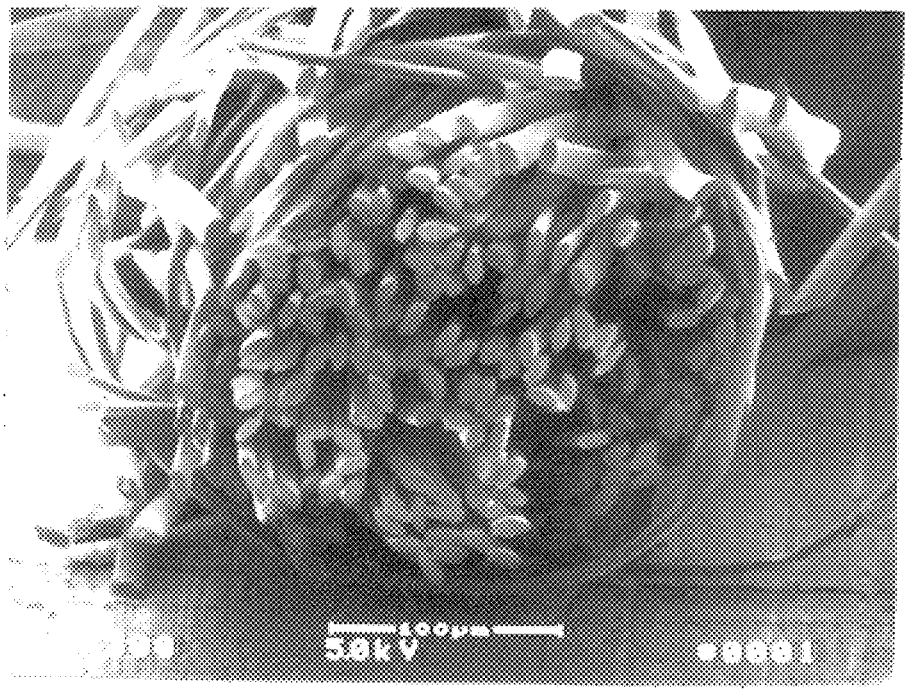
FIG. 2 is an enlarged photograph of polyester fibers in a spun yarn according to invention, with the ends of such fibers cut to show their simple oval cross-section.
Figure 3:
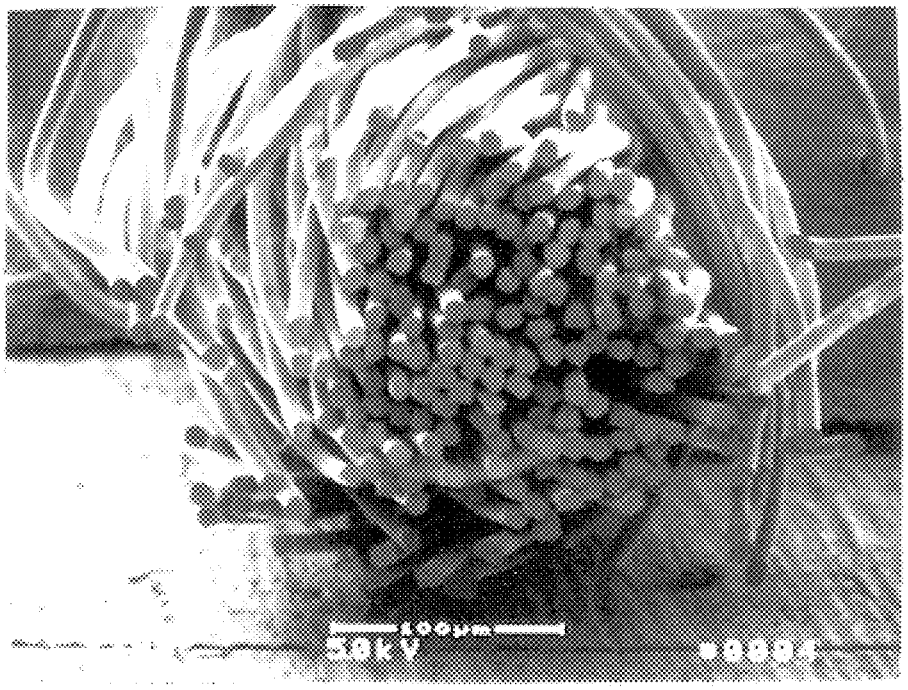
FIG. 3 is a similar photograph but of a spun yarn of polyester fibers of round cross-section, to show their difference in contrast to FIG. 2.

The polymer melt-spun into filaments in each Example was poly(ethylene terephthalate) polymerized with the addition of 0.12 mole % of trimellitate chain-brancher (added as trihydroxyethyl trimellitate). As indicated, the polymer in Example 4 also contained a significant amount of PEO. The relative viscosities of the polymers were measured essentially as described by Hancock et al. U.S. Pat. No. 4,704,329, col. 9 lines 6–11, but on a solution obtained by dissolving 0.40 grams of fiber in 5.0 ml. of solvent. The round filaments spun to provide controls were of course spun through circular orifices. The scalloped-oval (4gSO) and peanut filaments spun to provide comparisons were spun through orifices of configuration essentially as shown in FIG. 2 of Clark et al U.S. Pat. No. 4,707,407, and FIG. 6 of Tanaka Japanese Heisei 4-370,209, respectively, both referred to hereinabove. The simple oval comparison filaments D & E in Table I (aspect ratios, respectively, only 1.5:1 and 1.7:1) were spun through orifices shaped like slots, of lengths, respectively, 15 mil (0.38 mm) and 16 mil (0.4 mm), with rounded bulges outwards in the middle of each longer side of the slots, of maximum width, respectively, 7 mil (0.18 mm) and 5 mil (0.15 mm), the slot for D being otherwise shaped like a rectangle with squared corners at each end, while the slot for E had radiused ends. The simple oval filaments spun to provide staple fiber yarns according to the invention (drawn fiber aspect ratios 2.5, 2.7 and 3.2) were all spun through slots with parallel longer sides of overall lengths, respectively, 16 mil (0.4 mm), 15 mil (0.38 mm) and 28 mil (0.71 mm), and widths, respectively, 3.5 mil (0.089 mm), 3 mil 0.076 mm) and 4.3 mil (0.109 mm), the first and third of such slots having radiused ends, while the second was a rectangularly-shaped orifice As will be understood, these slots produced filaments of simple oval cross-section because the freshly-extruded melt bulged immediately under the orifices, the viscosity of the polymer, the quenching and the wind-up speed being important factors and empirical experimentation generally being desirable to obtain the particular non-round cross-sectional configuration desired, as is understood by those skilled in this art. Oval filaments may be made from orifices of other shapes, as is also well understood, e.g., from orifices that are themselves of oval shape, or with bulges, if desired. The ability to make polyester filaments of various smooth non-round cross-sections was previously known and is not part of the present invention, which is directed to the surprising advantages that we have found in using polyester fiber of simple oval peripheral cross-section having aspect ratios as claimed.

The resulting filaments were then drawn, annealed, crimped and lubricated as described to give dpf, tensile and crimp properties as near alike as possible.

Aspect ratio with regards to this disclosure is defined as the ratio of the maximum length to maximum width of the periphery of the filament cross-section, the length being the longest axis, and the length and width axes being perpendicular, normally but not necessarily taken through the centers of the samples. Aspect ratios were obtained by measuring the lengths and widths of multiple samples of drawn fibers, using cross-section images of each particular sample, according to the following procedure. A fiber specimen is mounted in a Hardy microtome (Hardy, U.S. Department of Agriculture circa 378, 1933) and divided into thin sections according to methods essentially as disclosed in "Fiber Microscopy Its Technique and Applications", by J. L. Sloves (van Nostrand Co., Inc., New York 1958, No. 180–182). Thin sections are then mounted on a super FIBERQUANT video microscope system stage (Vashaw Scientific Co., 3597 Parkway Lane, Suite 100, Norcross, Georgia 30092) and displayed on the Super FIBERQUANT CRT under magnifications as needed. The image of an individual thin section of one fiber is selected and critical fiber dimensions measured. The ratios are then calculated. This process is repeated for each filament in the field of view to generate a statistically significant sample set, and the averages are given herein.

Tensile properties were measured using either a Model 1122 or 1123 Instron on fibers using a 0.5 inch (13 mm) gauge length.

Finish levels are given as FOT % (Finish on Tow) and were obtained on polyester fiber cut from the tow, using the well known tube elution method that gravimetrically determines the weight percent of finish oils after extracting the oils from the fiber with methanol, as a percentage of the weight of the fiber.

CPI (crimps per inch) were determined conventionally by counting the number of crimps per extended length of filament.

Open-end spinning (OES) trials were carried out on Schlafhorst SE-9 or SE-8 spinning frames using 100% or 50/50 cotton blend sliver prepared as described in the Examples. Spinning frame setup and conditions (including room temperature - humidity conditions) were held constant during each Example except for any adjustment of rotor speed per test design. For each Example, items were assayed one by one over a common set of 24 machine positions (rotors) for periods of 5 to 10 hours. Ends down (yarn formation failures in the spinning box) were tracked by the SE-8 or SE-9 instrumentation and the failure data normalized to express failures in terms of 1000 rotor hours for each item.

To compare Dye Yields, each item was spun into 100% 20/1 cc (295 dtex) open-end yarns on a Schlafhorst SE-8. The resulting yarns were knitted into fabrics and then dyed in separate baths using 2% Terasil Blue GLF dyestuff per gram of fabric and a dye bath rate of rise of 3° F. (2° C.) per minute from room temperature up to 260° F. (127° C.) with a 30 minute hold at 260° F., a typical procedure used commercially for the dyeing of polyester. The dyed fabrics were then dried and instrumentally compared on a Color Mate HDS Color Analyzer using D65 standard daylight illuminant. The instrument provides a Delta E value that quantifies any difference from the color of the round fiber standard. A Delta E value greater than 0.7 units from standard is estimated as a dye shade difference of 1, so, for convenience, the number of shade differences are shown in the Tables as well as the Delta E values.

EXAMPLES

Example 1

Polyester filament samples having different oval-shaped cross-sections were melt-spun from polymer of 19 LRV through spinnerets fitted with capillaries designed to give different specific cross-section shapes in the fully-drawn fibers. Filaments were collected at 1800 yards per minute (1650 mpm) on bobbins using a commercial winding device. Bobbin lots of 2.5 and 3.2 aspect ratio simple oval cross-section according to the invention were prepared in this manner as well as the following comparisons that are not according to the invention, namely simple oval cross-sections of lower aspect ratio 1.5 and 1.7, more complex peanut-shaped and a 4 groove (4gSO) scalloped-oval cross-section, and a round cross-section as a control. Each bobbin lot was combined into a tow (from a creel) which was drawn, steam-annealed, crimped and dried to give a denier per filament of 1.2 (1.3 dtex) and similar tensile and crimp properties as given in Table 1. The same standard commercial lubrication useful for open-end spinning was applied to all the items during the drawing and crimping operation. The tensile and crimp properties and finish (FOT) in Table 1 are for the raw fibers.

Each test lot was cut to standard 1.25 inch (32 mm) fiber length and carded as 100% polyester. Some was spun into 100% polyester yarns and compared for Dye Yield as described hereinbefore, while other portions were draw frame blended with 70 grain (4.5 gm) carded cotton to give a 50/50 polyester cotton blend sliver of 68 grain (4.4 gm) weight, followed by finisher drawing to complete the draw blending operation and reduce the sliver weight to 60 grains (3.9 gm), which slivers were competitively spun into 28/1 cc (210 dtex) yarns on common rotors of a Schlafhorst SE-9 against the round control and the results are shown in Table 1, from which it can be seen that all the oval shapes tested gave significant reductions in ends down, i.e., significant improvements in OES process capability over the round commercial control.

TABLE 1

| | COMPARISONS | | | | | INVENTION | |
|---|---|---|---|---|---|---|---|
| | A | B | C | D | E | 1 | 2 |
| Fiber Shape | round control | 4gSO | peanut | oval | oval | oval | oval |
| Aspect Ratio | 1.0 | 1.6 | 2.2 | 1.5 | 1.7 | 2.5 | 3.2 |

TABLE 1-continued

| | COMPARISONS | | | | | INVENTION | |
|---|---|---|---|---|---|---|---|
| | A | B | C | D | E | 1 | 2 |
| Fiber Properties | | | | | | | |
| Tenacity g/d | 5.2 | 5.2 | 5.3 | 5.0 | 5.1 | 4.9 | 5.3 |
| (g/dtex) | (4.7) | (4.7) | (4.8) | (4.5) | (4.6) | (4.4) | (4.8) |
| $T_{10}$ g/d | 4.1 | 3.8 | 4.0 | 3.5 | 3.9 | 3.8 | 3.8 |
| (g/dtex) | (3.7) | (3.4) | (3.6) | (3.2) | (3.5) | (3.4) | (3.4) |
| Elongation, % | 20 | 19 | 19 | 24 | 22 | 18 | 18 |
| CPI | 9.2 | 8.7 | 9.4 | 8.7 | 9.5 | 7.9 | 9.5 |
| (CPcm) | (3.6) | (3.4) | (3.7) | (3.4) | (3.7) | (3.1) | (3.7) |
| FOT % | 0.16 | 0.17 | 0.17 | 0.15 | 0.14 | 0.17 | 0.15 |
| OES Process Capability Ends Down/1M Rotor Hours - at 105M RPM | 303 | — | — | 60 | 72 | 153 | 119 |
| Dye Yield Properties | | | | | | | |
| Delta E | std | 4.3 | 3.3 | 5.0 | 2.2 | 0.6 | 1.4 |
| Shades Light | std | 6 | 4.5 | 7 | 3 | <1 | 2 |

The dye advantage for simple oval cross-sections according to the invention is easily seen from Table 1, in contrast to oval cross-sections having Aspect Ratios of 1.5 and 1.7, which incurred substantial dye yield losses of 3 and 7 shades. Likewise, 4.5 and 6 shades of dye yield loss were incurred with the more complex cross-sections such as the peanut and the 4g scalloped-oval cross-section, although the peanut cross-section had an aspect ratio within the range of 2 to 3.5.

In other words, polyester fibers according to the invention having simple oval cross-sections with high enough aspect ratios did not show much dye yield loss as compared with the same commercial standard, and in contrast to the other cross-sections tested, which showed significant dye yield losses, and did show significant improvements in OES process capability (at most about half the number of ends down as tested and compared with the round standard).

Example 2

Another set of filaments having different cross-sections were prepared essentially as described in Example 1. These bobbin lots had fibers having a normal round cross-section as a control, a simple oval of 2.7 aspect ratio according to the invention, and two peanut cross-sections, each of aspect ratio 2.0 as comparisons. Their properties are listed in Table 2.

These items were cut to a standard 1.25 inch (32 mm) length and some portions were tested to compare Dye Yields as described hereinbefore, while other portions were preblended 50/50 with cotton before the blends were carded to 70 grain (4.5 gm) slivers, and then drawn in 2 steps to 60 grain (3.9 gm) slivers for open-end spinning trials essentially as described for Example 1. The results are given in Table 2 and show the significant dye yield loss for one of the peanut cross-sections in contrast to the excellent dyeing performance for the fiber of simple oval cross-section according to this invention. Indeed, this simple oval cross-section according to the invention dyed more deeply than the round control. Table 2 also shows the dramatic reductions in ends down for the simple oval cross-section according to the invention, as well as for the peanut cross-sections.

TABLE 2

| FIBER PROPERTIES | COMPARISONS | | | INVENTION |
|---|---|---|---|---|
| Fiber Cross-section | Round | Peanuts | | Oval |
| | Control | | | |
| Aspect Ratio | 1.0 | 2.0 | 2.0 | 2.7 |
| Tenacity g/d (g/dtex) | 5.6 (5.0) | 5.2 (4.7) | 4.3 (3.9) | 4.9 (4.4) |
| $T_{10}$ g/d (g/dtex) | 4.3 (3.9) | 4.3 (3.9) | 2.7 (2.4) | 3.5 (3.2) |
| Elongation, % | 18 | 15 | 17 | 17 |
| CPI (CPcm) | 9.7 (3.8) | 11.0 (4.3) | 10.2 (4.0) | 10.6 (4.2) |
| FOY % | 0.13 | 0.16 | 0.13 | 0.14 |
| OES Process Capability Ends Down/1M Rotor Hours- at 110M RPM Rotor | 735 | 155 | 125 | 275 |
| Dye Yield Capability | | | | |
| Delta E | std | — | 3.3 | 0.4* |
| Shades Light | std | — | 5 | 0 |

*Dyed darker (1.e., better) than the round control standard.

Example 3

Filaments were spun, drawn and converted into staple essentially as described in Example 1 and then, as 100k polyester staple fiber, were carded to 60 grain 10 (3.9 gm) slivers and drawn in two steps to 50 grain (3.2 gm) slivers and assayed for performance capability on a Schlafhorst SE-8 open-end frame. The performance data showed that the round cross-section polyester staple gave an unacceptably high level of ends down (420/1000 rotor hours exceeding commercial goal of no more than 200) at 70,000 RPM rotor speed, whereas the polyester fiber of simple oval cross-section according to this invention gave zero ends down at a higher rotor speed of 75,000 RPM. The peanut oval comparison also gave excellent open-end performance, but unacceptable loss in dye yield, in contrast to the fiber of the invention, as indicated in Table 3.

TABLE 3

| FIBER PROPERTIES | COMPARISONS | | INVENTION |
|---|---|---|---|
| Fiber Cross-Section | Round Control | Peanut | Oval |
| Aspect Ratio | 1.0 | 2.0 | 2.7 |

TABLE 3-continued

| FIBER PROPERTIES | COMPARISONS | | INVENTION |
|---|---|---|---|
| Dpf (dtex) | 1.05 (1.17) | 1.05 (1.17) | 1.02 (1.13) |
| Tenacity g/d (g/dtex) | 5.8 (5.2) | 5.9 (5.3) | 5.9 (5.3) |
| $T_{10}$ g/d (g/dtex) | 3.7 (3.3) | 4.7 (4.2) | 4.6 (4.1) |
| Elongation, % | 16 | 13 | 13 |
| CPI (CPcm) | 11.3 (4.4) | 9.6 (3.8) | 10.1 (4.0) |
| FOT % | 0.10 | 0.14 | 0.12 |
| Dye Yield Capability | | | |
| Delta E | std | 3.1 | 0.4 |
| Shades Light | std | 4 | <1 |

Example 4

Sample filaments having round cross-section (as a control again) and simple oval cross-section according to the invention were produced from polymer of about 20.3 LRV and about 2.3% by weight of PEO, poly(ethylene 10 oxide) of 600 MW, but in other respects essentially as described in Example 1, and were processed and spun into yarns at a rotor speed of 107,000 RPM and compared also essentially as described in Example 1. Relevant parameters and results are summarized in Table 4, from which it can be seen that the fibers of simple oval cross-section according to the invention were processed into spun yarn much better (only a quarter of the failures encountered with the round control) without much loss in dye yield.

TABLE 4

| POLYMER | CONTROL | INVENTION |
|---|---|---|
| LRV | 20.4 | 20.2 |
| 600 MW PEO, wt % | 2.1 | 2.5 |
| Fiber Properties | | |
| Fiber Cross-Section | round | oval |
| Aspect Ratio | 1.0 | 2.5 |
| Denier/Filament (dtex) | 1.24 (1.38) | 1.28 (1.42) |
| Tenacity gpd (g/dtex) | 5.9 (5.3) | 5.1 (4.6) |
| $T_{10}$ gpd (g/dtex) | 3.7 (3.3) | 2.2 (2.0) |
| Elongation, % | 21 | 21 |
| CPI (CPcm) | 9.2 (3.6) | 9.1 (3.6) |
| FOT % | 0.14 | 0.15 |
| OES Process Capability | 228 | 55 |
| Ends Down/1M Rotor Hours-at 107M RPM Rotor Speed | | |
| Dye Yield Capability | | |
| Delta E | std | 1.0 |
| Shades Light | std | 1.5 |

For convenience, the Dye Yields (Delta E values) for various fiber cross-sections that we have tested and measured have been plotted vs. the Aspect Ratios of the cross-sections of the constituent polyester staple fibers in the yarns of the dyed fabrics and are shown in FIG. 1 of the accompanying drawings. A round cross-section standard has an Aspect Ratio of 1.0:1 and a ΔE of 0.0. The simple oval cross-sections of various aspect ratios mostly required more dye (except for the oval cross-section of Example 2 that dyed darker than the round control standard) as shown in FIG. 1, and generated a curve, as shown, indicating a relationship between aspect ratio and ΔE, wherein for oval fibers of low aspect ratio (not according to the invention) the ΔE increased very sharply as the aspect ratio was increased from 1.0:1, and then, after peaking, decreased sharply as the aspect ratio was further increased beyond the peak, and then, after dropping below a ΔE value of about 1.0, at an aspect ratio of about 1.85:1, the rate of decrease of the ΔE with increasing aspect ratio levelled off and the curve becomes quite flat at an aspect ratio of about 2.0:1, and then, after a higher aspect ratio (about 2.5:1), the ΔE increases somewhat with increasing aspect ratio. The relationship between ΔE and aspect ratio was very surprising. It was especially surprising to find that the ΔE for aspect ratios of about 1.85:1 and more were so significantly less than for oval cross-sections of lower aspect ratio, such as 1.5:1, and that such polyester staple fibers gave significant advantages in open-end spinning over conventional polyester staple fiber of round cross-section, but dyed so much more efficiently than polyester staple fiber having other oval cross-sections, especially those of lower aspect ratio. In addition to the plots for simple oval cross-sections, the complex oval cross-sections are shown in FIG. 1 as "x" points, for the (4 groove) scalloped-oval cross-section and the peanut cross-sections used as Comparisons in the foregoing Examples.

As indicated, we have found that the ΔE dye yield is about 1.0 or less when the aspect ratio is about 1.85:1 or more, i.e., use of simple oval cross-sections having such aspect ratios, surprisingly, have given shade differences of about 1.5 or less as compared with conventional round cross-sections, together with improved open-end spinning capability. When the slope of the curve is relatively steep below about 2.0:1, and especially below about 1.9:1 aspect ratio, the dye yield becomes more sensitive to aspect ratio changes, so that dye yield management becomes more difficult. This is one reason why we prefer to operate outside such a potential problem area, i.e., at least about 2.0:1, and especially at about 2.1:1 aspect ratio or somewhat more. However, with proper care, e.g., of spinneret design and careful polymer viscosity management, we believe that somebody could operate using lower aspect ratios, such as 1.85–1.95, and get acceptable dye yields.

Although the dye yield data in FIG. 1 was obtained by comparing fabrics of yarns obtained by open-end spinning, the surprising advantages in dye yield are believed to result from the fiber cross-section and are not confined to open-end spun yarns (the productivity improvement for which has been of especial potential commercially) but is also believed applicable to other yarns of staple fibers or continuous filaments of similar cross-section (similar aspect ratios). In addition, aesthetic advantages have been noted (in contrast to round cross-sections) in that 100% polyester knit fabrics made from yarns of fibers with the oval cross-sections (2.5:1 aspect ratio) have been rated as softer, smoother and less harsh than those of round cross-section, by a panel of experts.

We claim:

1. A process comprising open-end spinning polyester staple fiber alone, or mixed with cotton, said polyester staple fiber having a simple oval cross-section of aspect ratio about 1.85:1 to about 3.5:1.

2. A process according to claim 1, wherein said aspect ratio is at least about 2.0:1.

3. A process according to claim 2, wherein said aspect ratio is about 2.1–2.5:1.

* * * * *